US007845178B1

(12) United States Patent
Suharno et al.

(10) Patent No.: US 7,845,178 B1
(45) Date of Patent: Dec. 7, 2010

(54) A/C MAINTENANCE SYSTEM USING HEAT TRANSFER FROM THE CONDENSER TO THE OIL SEPARATOR FOR IMPROVED EFFICIENCY

(75) Inventors: Anwar Suharno, Lincolnshire, IL (US); Dean P. Pfefferle, Lincolnshire, IL (US); Craig Govekar, Lincolnshire, IL (US)

(73) Assignee: SPX Corporation, Charlotte, NC (US)

( * ) Notice: Subject to any disclaimer, the term of this patent is extended or adjusted under 35 U.S.C. 154(b) by 461 days.

(21) Appl. No.: 11/641,105

(22) Filed: Dec. 19, 2006

(51) Int. Cl.
*F25B 45/00* (2006.01)

(52) U.S. Cl. ..... 62/77; 62/149; 62/470; 62/503

(58) Field of Classification Search ..... 62/292, 62/77, 149, 503, 513, 470
See application file for complete search history.

(56) References Cited

U.S. PATENT DOCUMENTS 3,131,553 A * 5/1964 Ross ..... 62/506
4,217,765 A * 8/1980 Ecker ..... 62/503
4,646,527 A * 3/1987 Taylor ..... 62/85
4,768,355 A * 9/1988 Breuhan et al. ..... 62/503
4,998,413 A * 3/1991 Sato et al. ..... 62/149
5,157,936 A * 10/1992 Wall ..... 62/292
5,261,249 A * 11/1993 Manz et al. ..... 62/149
5,277,032 A * 1/1994 See et al. ..... 62/125
5,369,959 A 12/1994 Pfefferle et al.
5,412,955 A 5/1995 Husarik et al.
5,479,788 A * 1/1996 Roegner ..... 62/292
5,535,595 A * 7/1996 Manz ..... 62/85
5,617,731 A * 4/1997 Scaringe ..... 62/149
6,263,691 B1 * 7/2001 Ueno et al. ..... 62/292
6,843,070 B1 1/2005 Suharno
2005/0220924 A1 * 10/2005 Blankenship et al. ..... 425/407

OTHER PUBLICATIONS

Air Conditioning and Refrigeration. William H. Severns and Julian R. Fellows. Fifth Printing 1966. John Wiley and Sons.*

* cited by examiner

*Primary Examiner*—Mohammad M Ali
(74) *Attorney, Agent, or Firm*—Baker & Hostetler LLP

(57) ABSTRACT

An apparatus and methodology are provided for advantageously increasing heat transfer between the evaporator/oil separator ("accumulator") and condenser of a refrigerant recovery/recycling system, to increase the efficiency of the system and to simplify the system. Embodiments include a refrigerant recovery/recycling device comprising a compressor having a suction inlet and a discharge outlet; an accumulator fluidly connected to a refrigerant source and to the compressor suction inlet; a recovery tank fluidly connected to the compressor discharge outlet; and a heat exchanger for transferring heat from the recovery tank to the accumulator, for raising the temperature of the accumulator and lowering the temperature of the recovery tank.

10 Claims, 4 Drawing Sheets

A/C MAINTENANCE SYSTEM USING HEAT TRANSFER FROM THE CONDENSER TO THE OIL SEPARATOR FOR IMPROVED EFFICIENCY

TECHNICAL FIELD

The disclosure relates to refrigerant handling systems and, in particular, to systems and methodology for recovering and recycling refrigerant from a refrigeration system and recharging recycled refrigerant to the refrigeration system. The disclosure has particular application to techniques and apparatus for improving the efficiency of such refrigerant recovery/recycling systems.

BACKGROUND ART

Heretofore, when refrigerant-charged refrigeration systems, such as automotive air conditioning systems, were repaired, the refrigerant charge was simply vented to atmosphere to accomplish the repairs. More recently, it has become increasingly important to capture and reuse the refrigerant charge in such refrigeration systems, both to avoid pollution of the atmosphere and to minimize the increasing costs of disposal and replacement of the refrigerant charge. As used herein, "recover" means to remove used refrigerant from refrigeration equipment and collect it in an appropriate external container. "Recycle" means to reduce the amount of contaminants in used refrigerant so that it can be reused. Systems for recovering and recycling used refrigerant typically extract it from a refrigeration system in gaseous form, remove oil and moisture from the refrigerant, condense the refrigerant to liquid form, and store it in a recovery tank.

A block diagram of a conventional refrigerant recovery/recycling system, in the form of a vehicle air conditioning maintenance system, is shown in FIG. 1. The air conditioning maintenance system 100 includes ports 101, 102 which are respectively connected to the high pressure side and low pressure side of a refrigeration system, such as a vehicle air conditioning system (not shown). A compressor 110 pulls the refrigerant from the air conditioning system through the ports 101, 102, past gauges 103, 104, and valves 105, 106 into an evaporator/oil separator 120, also called an accumulator. In accumulator 120, any lubricant (usually an oil) which has flowed along with the refrigerant from the vehicle to the maintenance system 100 drops to the bottom of its oil separator. At the end of a recovery operation, any oil that has been collected is drained into a bottle. Accumulator 120 becomes cool during operation, because liquid refrigerant in accumulator 120 changes to the gaseous phase as it passes through. In fact, conventional accumulators 120 can become cold enough for ice to form on their outer surfaces. However, accumulator 120 is more efficient when warm. Consequently, a heat blanket (not shown) or the like is usually employed to warm accumulator 120 to help vaporize any liquid refrigerant.

The vaporized refrigerant is pulled out of accumulator 120 and passes through filter/dryer 130, where any moisture is removed, before entering the suction side of compressor 110. Refrigerant is pushed out of compressor 110 as a high-pressure, high-temperature gas. Some of compressor 110's oil may be pushed out in solution with the refrigerant. The refrigerant and oil from compressor 110 flows into the top of a compressor oil separator 111, where any oil drops to the bottom and is later returned to compressor 110 via a solenoid 112.

The pressurized, hot vaporous refrigerant then flows through a check valve 113 and into the finned tubing of a condenser 140. A fan (not shown) pushes relatively cool ambient air through the fins of condenser 140, which transfers heat from the refrigerant to the atmosphere, causing the gaseous refrigerant to condense into a liquid. The liquid refrigerant then flows to a recovery tank 150.

Accumulator 120 becomes cool when operating, but is more efficient when warm. Conversely, condenser 140 and recovery tank 150 are heat-producing components that are more efficient when cool. Moreover, when operating in high ambient temperatures, the efficiency of conventional refrigerant recovery/recycling systems decreases significantly. To meet efficiency goals over a range of operating temperatures, conventional systems warm their accumulators using a heat blanket and cool their condensers using a fan and air flow controls, which consume energy and complicate the system, thereby raising the cost of production and operation. There exists a need for an apparatus and methodology for a simplified, less costly, more efficient refrigerant recovery/recycling system.

SUMMARY OF THE DISCLOSURE

An apparatus and methodology is disclosed for advantageously increasing heat transfer between the evaporator/oil separator and condenser of a refrigerant recovery/recycling system to increase the efficiency of the system and to simplify the system, thereby reducing operating costs and production costs.

The foregoing and other advantages are achieved in part by a refrigerant recovery/recycling device comprising an accumulator fluidly connected to a refrigerant source and to a compressor suction inlet, and a recovery tank fluidly connected to a compressor discharge outlet. The accumulator and the recovery tank are disposed for transferring heat from the condenser to the recovery tank, for raising the temperature of the accumulator and lowering the temperature of the recovery tank.

Another aspect of the disclosure is a refrigerant recovery/recycling device comprising an accumulator fluidly connected to a refrigerant source and to a compressor suction inlet, and a condenser fluidly connected to a compressor discharge outlet. The accumulator and the condenser are disposed for transferring heat from the condenser to the accumulator, for raising the temperature of the accumulator and lowering the temperature of the condenser.

Additional advantages will become readily apparent to those skilled in this art from the following detailed description, wherein only exemplary embodiments are shown and described. As will be realized, the present disclosure can include other and different embodiments, and its several details are capable of modifications in various obvious respects, all without departing from the disclosure. Accordingly, the drawings and description are to be regarded as illustrative in nature, and not as restrictive.

BRIEF DESCRIPTION OF THE DRAWINGS

Reference is made to the attached drawings, wherein elements having the same reference numeral designations represent like elements throughout, and wherein.

DETAILED DESCRIPTION

The present disclosure provides a heat transfer mechanism between an evaporator/oil separator, hereinafter "accumulator" (a component that becomes cool during operation but is more efficient when warm), and a recovery tank (a component that becomes warm but is more efficient when cool). The heat transfer mechanism improves the recovery efficiency of the refrigerant recovery/recycling system and the purity of the recovered refrigerant. Moreover, systems incorporating the present disclosure are simplified because certain conventional heating and cooling mechanisms, such as the accumulator heat blanket and the condenser, are eliminated.

Several embodiments utilize the principle of using heat loss and heat gains of the accumulator and condenser, respectively, to improve the performance of the other. One embodiment uses a block of material having good thermal conductivity properties, such as aluminum, as a heat transfer mechanism located between the accumulator and the recovery tank. This heat transfer mechanism provides a thermal transfer path between the two components, as well as mechanical stability. In other embodiments, the accumulator, recovery tank, and condenser are all directly connected together to promote heat transfer, or the accumulator and the condenser are connected together. In a further embodiment, the accumulator is located in the recovery tank. This is done, for example, using concentric tanks, i.e., a small accumulator inside of the recovery tank.

Figure 1:
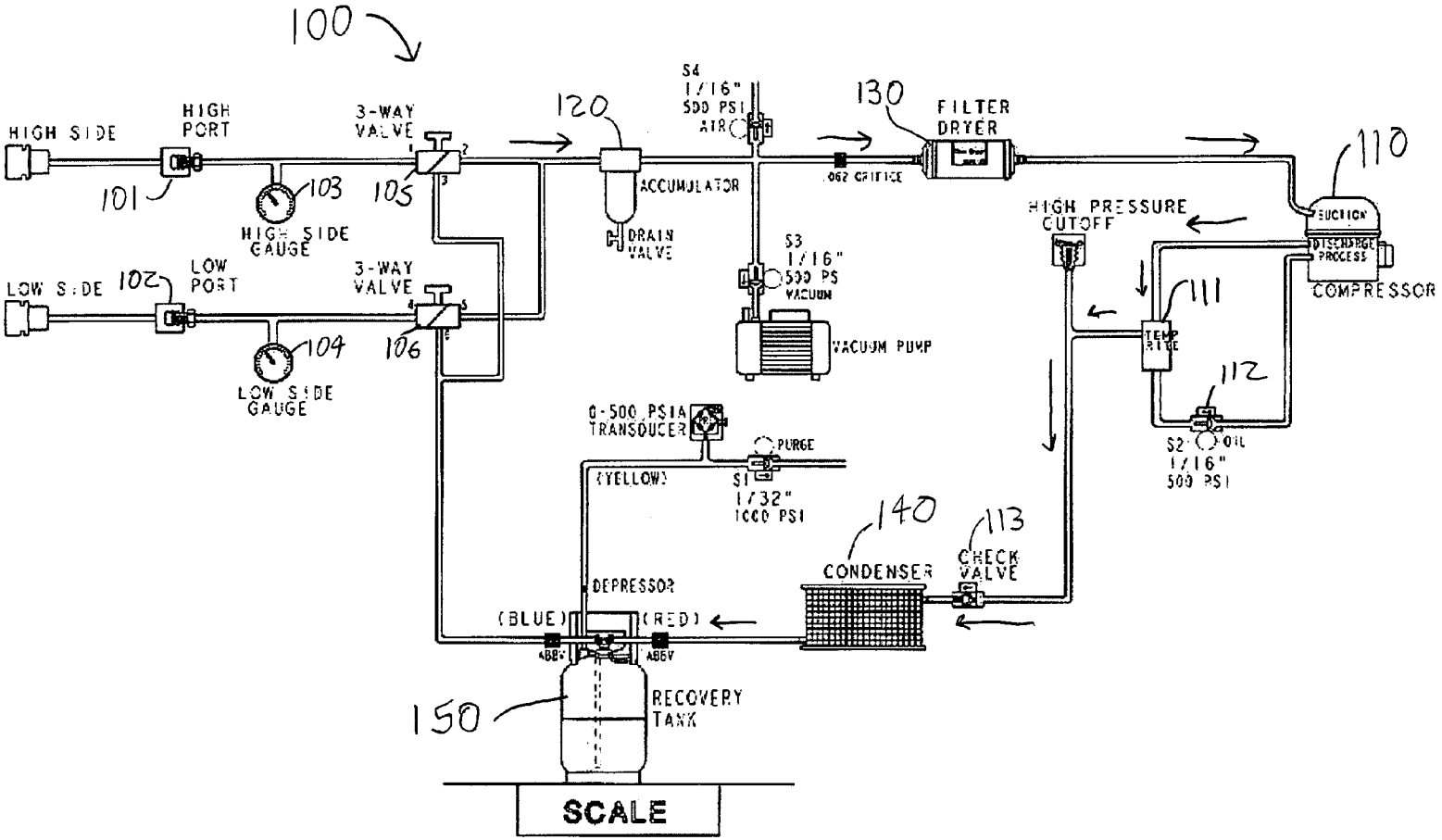
FIG. 1 (PRIOR ART)
FIG. 1 is a diagram of a conventional air conditioning maintenance system.
Figure 2A:
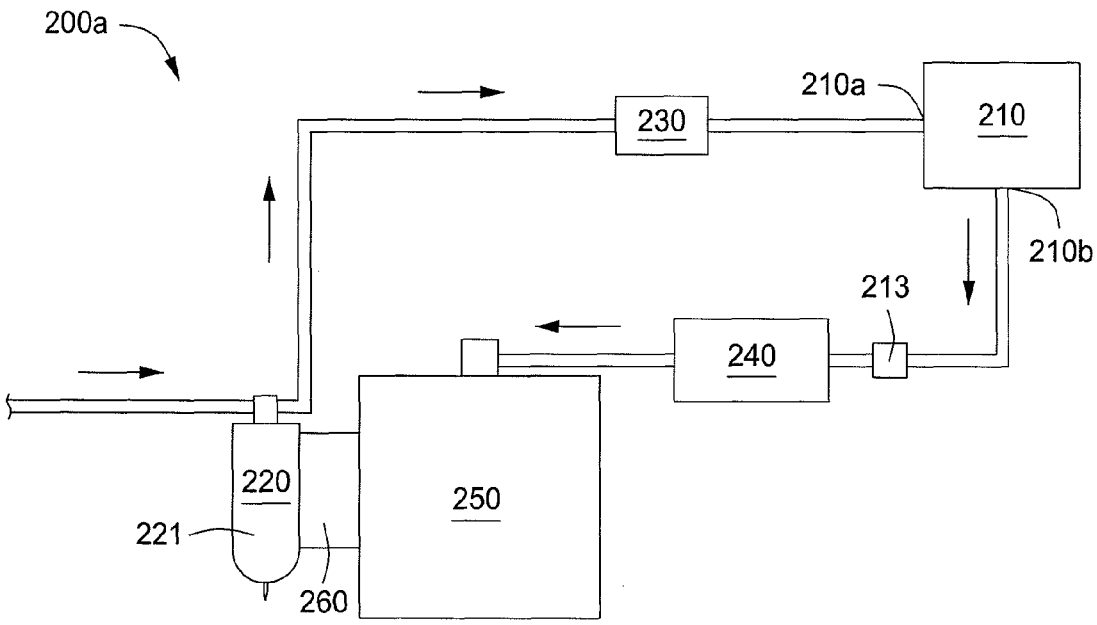
FIGS. 2*a-c*, 3, and 4*a-c* are block diagrams of refrigerant recovery/recycling systems according to embodiments of the present disclosure.

A block diagram of a refrigerant recovery/recycling system according to an exemplary embodiment is shown in FIG. 2*a*. The system 200*a* is connected to a refrigeration system, such as a vehicle air conditioning system (not shown). A conventional compressor 210 having a suction inlet 210*a* and a discharge outlet 210*b* pulls refrigerant (which can be in a liquid and/or gaseous form) from the air conditioning system into an accumulator 220, which includes a conventional oil separator 221. In accumulator 220, lubricant (i.e., oil) which has flowed along with the refrigerant from the vehicle to recovery/recycling system 200 drops to the bottom of oil separator 221. At the end of a recovery operation, any oil that has been collected is drained into a bottle. The refrigerant becomes vaporized as it passes through accumulator 220.

The vaporized refrigerant is pulled out of accumulator 220 and passes through a conventional filter/dryer 230, where any moisture is removed, before entering the suction inlet 210*a* of compressor 210. Refrigerant is pushed out of discharge outlet 210*b* of compressor 210 as a high-pressure, high-temperature gas. The pressurized, hot vaporous refrigerant then flows through a conventional check valve 213 and into the finned tubing of a condenser 240. A fan (not shown) pushes relatively cool ambient air through the fins of condenser 240, which transfers heat from the refrigerant to the atmosphere, causing the gaseous refrigerant to condense into a liquid. The liquid refrigerant then flows to a recovery tank 250.

In this embodiment, accumulator 220 is fixedly mounted to recovery tank 250 via a heat exchanger 260 comprising a block of thermally conductive material, such as aluminum. Accumulator 220, heat exchanger 260 and tank 250 are connected together in a conventional manner, such as by bolts, so that their surfaces contact each other and accumulator 220 is stably supported. Heat is thereby transferred from recovery tank 250, which becomes warm during operation of the system, through heat exchanger 260, to accumulator 220, which becomes cool during operation of the system. In other embodiments, no separate heat exchanger 260 is used, but accumulator 220 and tank 250 are connected directly together and their outer walls form the heat exchanger.

As a result of the heat transfer between tank 250 and accumulator 220, whether or not a separate heat exchanger 260 is employed, efficiency of the system 200*a* is increased. Since the temperature of recovery tank 250 is reduced, the refrigerant is more readily condensed to liquid form inside tank 250. Since the temperature of accumulator 220 is increased, the refrigerant flowing through it is more readily vaporized. Moreover, the need for a heat blanket to vaporize the refrigerant is eliminated, thereby simplifying system 200*a* and reducing its cost.

Condenser 240, located between compressor 210 and recovery tank 250, is used to liquefy and cool the refrigerant before going into recovery tank 250. In further embodiments, heat exchanger 260 cools recovery tank 250 sufficiently to eliminate condenser 240 and its associated fan and controls, thereby further simplifying system 200*a* and reducing its cost.

Figure 2B:
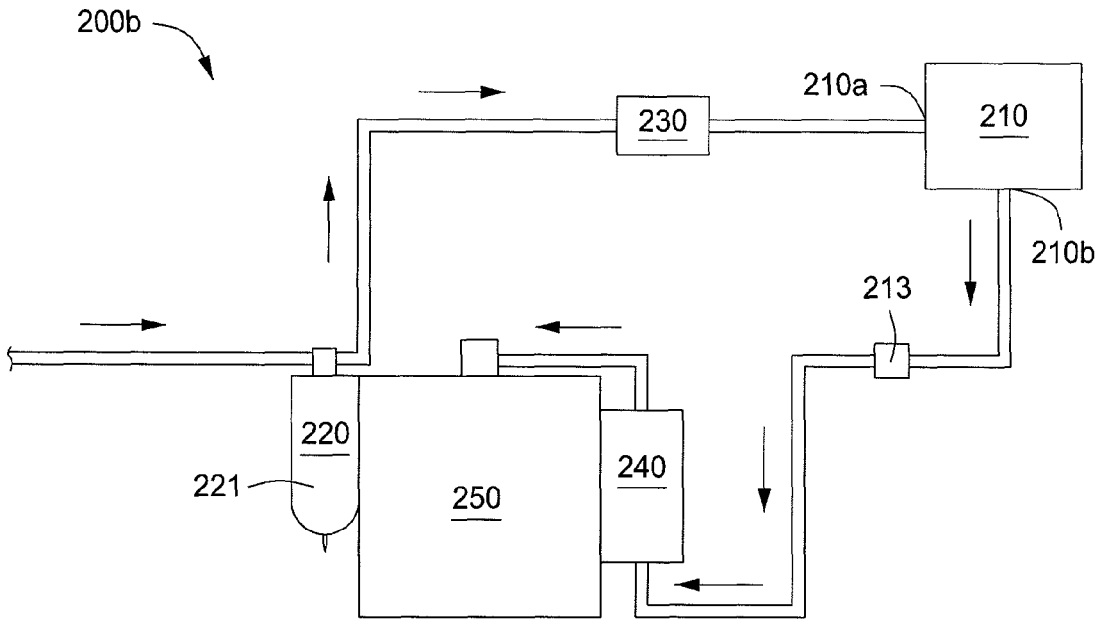

In a further embodiment, shown in FIG. 2*b*, accumulator 220 is fixedly, directly mounted to recovery tank 250, and condenser 240 is also fixedly directly mounted to recovery tank 250. In this embodiment, no separate heat exchanger is employed as in the embodiment of FIG. 2*a*; rather, the walls of the accumulator 220, recovery tank 250, and condenser 240 are employed as heat exchangers. Accumulator 220, tank 250, and condenser 240 are connected together in a conventional manner, such as by bolts, so that their surfaces contact each other and accumulator 220 and condenser 240 are stably supported. Heat is thereby transferred from recovery tank 250 and condenser 240, which become warm during operation of the system, to accumulator 220, which becomes cool during operation of the system.

As a result of the heat transfer between condenser 240, tank 250 and accumulator 220, efficiency of the system 200*b* is increased. Since the temperature of recovery tank 250 is reduced, the refrigerant is more readily condensed to liquid form inside tank 250. Since the temperature of accumulator 220 is increased, the refrigerant flowing through it is more readily vaporized. Moreover, the need for a heat blanket to vaporize the refrigerant is eliminated, thereby simplifying system 200*b* and reducing its cost. All other components of system 200*b* are similar or identical to like-numbered components of system 200*a* described hereinabove.

Figure 2C:
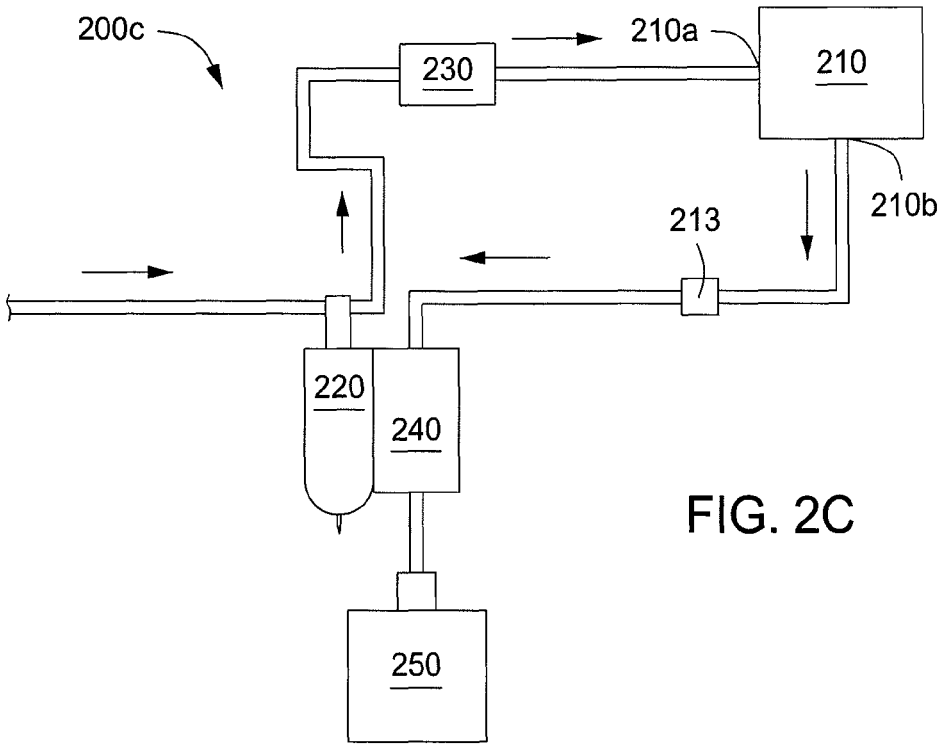

In another embodiment, shown in FIG. 2*c*, accumulator 220 is directly fixedly mounted to condenser 240. Accumulator 220 and condenser 240 are connected together in a conventional manner, such as by bolts, so that their surfaces contact each other and both are stably supported. Heat is thereby transferred from condenser 240, which becomes warm during operation of the system, to accumulator 220, which becomes cool during operation of the system.

As a result of the heat transfer between condenser 240 and accumulator 220, efficiency of the system 200*c* is increased. Since the temperature of condenser 240 is reduced, the temperature of the refrigerant entering recovery tank 250 is also reduced, so the refrigerant is more readily condensed to liquid form inside tank 250. Since the temperature of accumulator 220 is increased, the refrigerant flowing through it is more readily vaporized. Moreover, the need for a heat blanket around accumulator 220 to vaporize the refrigerant is eliminated, thereby simplifying system 200*c* and reducing its cost.

Figure 4A:
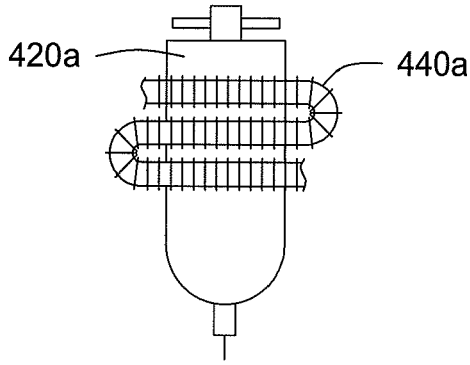
Figure 4B:
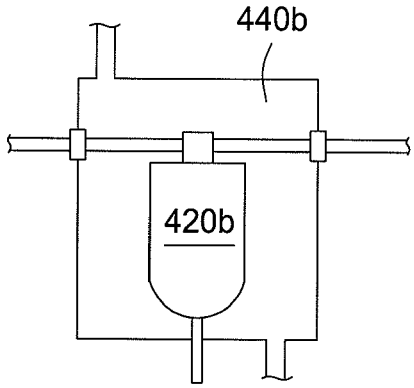
Figure 4C:
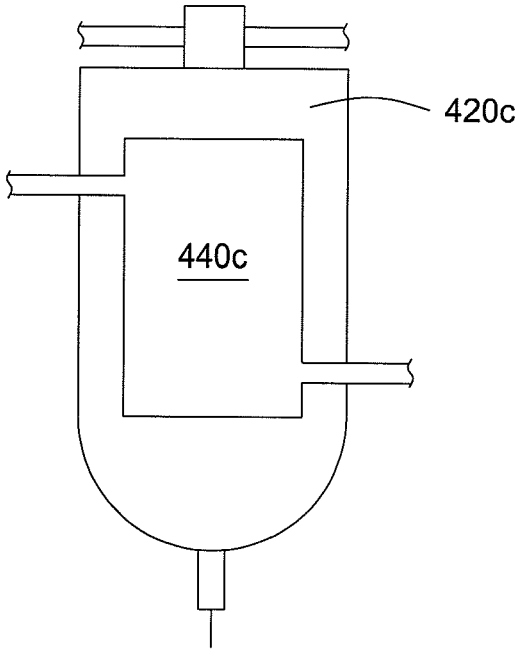

Although condenser 240 and accumulator 220 are shown in FIG. 2*c* as abutting each other, in further embodiments, shown in FIG. 4*a*, the coils of condenser 440*a* are wrapped around accumulator 420*a*, such that condenser 440*a* surrounds accumulator 420*a* to further improve heat transfer. In another embodiment, shown in FIG. 4*b*, accumulator 420*b* is located inside condenser 440*b*. In still another embodiment, shown in FIG. 4*c*, condenser 440*c* is located inside accumulator 420*c*. All other components of systems of these embodiments are similar or identical to like-numbered components of system 200*c* described hereinabove.

Figure 3:
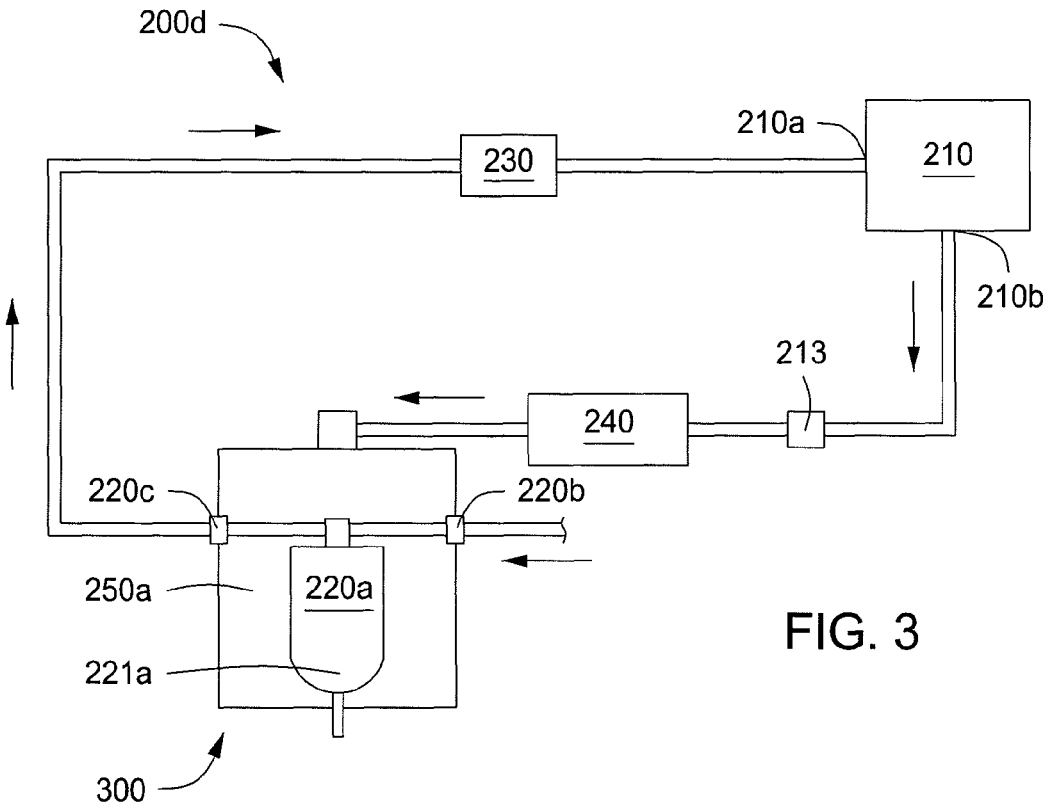

In another embodiment shown in FIG. 3, a refrigerant recovery system 200*d* comprises an apparatus 300 comprising a refrigerant recovery tank 250*a* and an accumulator 220*a* inside recovery tank 250*a* for transferring heat from recovery tank 250*a* to accumulator 220*a*. Accumulator 220*a* includes a conventional oil separator 221*a*, and has a fluid inlet 220*b* and a fluid outlet 220*c* accessible at an outside surface of recovery tank 250*a*. In certain embodiments, accumulator 220*a* and recovery tank 250*a* are concentric. All other components of system 200*d* are similar or identical to like-numbered components of system 200*a* described hereinabove.

As a result of the heat transfer between tank 250*a* and accumulator 220*a*, efficiency of the system 200*d* is increased. Since the temperature of recovery tank 250*a* is reduced, the refrigerant is more readily condensed to liquid form inside tank 250*a*. Since the temperature of accumulator 220*a* is increased, the refrigerant flowing through it is more readily vaporized. The need for a heat blanket to vaporize the refrigerant is eliminated, thereby simplifying system 200*d* and reducing its cost. In further embodiments, the heat transfer between recovery tank 250*a* and accumulator 220*a* cools recovery tank 250*a* sufficiently to eliminate condenser 240 and its associated fan and controls, thereby further simplifying system 200*d* and reducing its cost.

The increased efficiency of refrigerant recovery/recycling systems employing the heat transfer techniques of the embodiments enables systems using the embodiments to meet strict efficiency standards. For example, the Underwriter's Laboratories (UL) 120 Degree Ambient Test requires a system to meet limits for oil, air, and moisture contamination in the recovery process (i.e., purity) while maintaining a refrigerant recovery efficiency of 90%. The present disclosure provides a way to use heat generated by the refrigerant recycling/recovery system, which is disadvantageous in conventional systems, to warm the accumulator, thereby increasing overall recovery efficiency and purity of the recovered refrigerant.

The above-described embodiments can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the embodiments. However, it should be recognized that the embodiments can be practiced without resorting to the details specifically set forth. In other instances, well known processing structures have not been described in detail, in order not to unnecessarily obscure the present disclosure.

Only exemplary embodiments are shown and described in the present disclosure. It is to be understood that the embodiments are capable of use in various other combinations and environments and are capable of changes or modifications.

The embodiments described herein may include or be utilized with any appropriate voltage or current source, such as a battery, an alternator, a fuel cell, and the like, providing any appropriate current and/or voltage, such as about 12 Volts, about 42 Volts and the like.

The embodiments described herein may be used with any desired system or engine. Those systems or engines may comprise items utilizing fossil fuels, such as gasoline, natural gas, propane and the like, electricity, such as that generated by battery, magneto, fuel cell, solar cell and the like, wind and hybrids or combinations thereof. Those systems or engines may be incorporated into other systems, such as an automobile, a truck, a boat or ship, a motorcycle, a generator, an airplane and the like.

What is claimed is:

1. A refrigerant recovery/recycling device, comprising:

an accumulator, having an accumulator surface, fluidly connected to a refrigerant source and to a compressor suction inlet; and a recovery tank, having a tank surface, fluidly connected to a compressor discharge outlet;

wherein the accumulator and the recovery tank are disposed for transferring heat from a condenser to the recovery tank, for raising the temperature of the accumulator and lowering the temperature of the recovery tank conductively through at least the accumulator surface which is in contact with the surface of the recovery tank.

2. The device according to claim 1, wherein the accumulator comprises an oil separator.

3. The device according to claim 1, further comprising a heat exchanger including a block comprising a thermally conductive material to which the accumulator and the recovery tank are attached.

4. The device of claim 3, wherein the thermally conductive material comprises aluminum.

5. The device of claim 3, wherein the block is for supporting and mounting the accumulator to the recovery tank.

6. The device of claim 1, further comprising a condenser fluidly connected between the compressor discharge outlet and the recovery tank.

7. The device of claim 6, wherein the condenser is attached to the recovery tank for transferring heat from the condenser to the recovery tank.

8. The device of claim 1, wherein the accumulator is disposed inside the recovery tank.

9. The device of claim 8, wherein the accumulator and the recovery tank are concentric.

10. A method for improving the efficiency of a refrigerant recovery/recycling device having an accumulator, with an accumulator surface, for receiving a refrigerant, a recovery tank with a tank surface, and a compressor for pumping the refrigerant from the accumulator to the recovery tank, the method comprising transferring heat from the recovery tank to the accumulator conductively through at least the accumulator surface which is in contact with surface of the recovery tank to raise the temperature of the accumulator and to lower the temperature of the recovery tank.

* * * * *